US011492807B2

(12) United States Patent
Perez

(10) Patent No.: US 11,492,807 B2
(45) Date of Patent: Nov. 8, 2022

(54) RAIL BRACKET

(71) Applicant: Carlos Leon Perez, West Valley City, UT (US)

(72) Inventor: Carlos Leon Perez, West Valley City, UT (US)

( * ) Notice: Subject to any disclaimer, the term of this patent is extended or adjusted under 35 U.S.C. 154(b) by 82 days.

(21) Appl. No.: 16/948,032

(22) Filed: Aug. 27, 2020

(65) Prior Publication Data

US 2022/0064959 A1 Mar. 3, 2022

(51) Int. Cl.
*E04F 11/18* (2006.01)
*E04G 21/32* (2006.01)

(52) U.S. Cl.
CPC ..... *E04F 11/1838* (2013.01); *E04F 11/1812* (2013.01); *E04G 21/3219* (2013.01)

(58) Field of Classification Search
CPC ... E04F 11/18; E04F 11/1802; E04F 11/1804; E04F 11/1838; E04F 11/1812; E04H 17/1447; E04H 17/1452; E04H 17/1456; E04H 17/146; E04H 17/1488; E04G 21/32; E04G 21/3204; E04G 21/3219; E04G 21/3223
See application file for complete search history.

(56) References Cited

U.S. PATENT DOCUMENTS 358,461 A * 3/1887 Lee ..... 256/65.06
841,777 A * 1/1907 Hamilton et al. ..... 52/283
5,192,056 A * 3/1993 Espinueva ..... E04H 17/1447 256/65.06
5,547,169 A * 8/1996 Russell ..... E04H 17/1439 256/65.05
6,173,906 B1 * 1/2001 Von Kerens ..... E04H 17/1413 47/33
6,398,193 B1 * 6/2002 DeSouza ..... E04H 17/1447 256/65.06
7,731,160 B2 * 6/2010 Terrels ..... E04F 11/1836 256/65.06
9,896,864 B2 * 2/2018 Zhu ..... E04H 17/22
2003/0015696 A1 * 1/2003 Watson ..... E04G 21/3223 256/65.14

(Continued)

FOREIGN PATENT DOCUMENTS

CA 2394255 A1 * 1/2003 ..... E04F 11/1812
CA 2545924 A1 * 11/2006 ..... E04G 21/28

(Continued)

*Primary Examiner* — Jonathan P Masinick

(57) ABSTRACT

A guardrail assembly comprising a first bracket coupled to a first vertical surface and a second bracket coupled to a second vertical surface spaced from the first vertical surface. The first bracket includes a first socket and a second socket. The first socket supports a first horizontal rail and comprises a first support surface and two walls extending from the first support surface to define a gap therebetween to receive the first rail. The first socket defines an opening at an end of the two walls to allow the first horizontal rail to be removed from the first socket by lifting the rail. The second socket is similar to the first socket and supports a second rail. The second bracket is similar to the first bracket, with a third socket supporting a second portion of the first rail, and a fourth socket supporting a second portion of the second rail.

17 Claims, 7 Drawing Sheets

(56) References Cited

U.S. PATENT DOCUMENTS

| | | | | |
|---|---|---|---|---|
| 2003/0030048 | A1* | 2/2003 | Quaintance | E04H 17/1417 256/59 |
| 2003/0122116 | A1* | 7/2003 | Calverley | E04H 17/143 256/25 |
| 2003/0127575 | A1* | 7/2003 | Forbis | E04H 17/1417 248/251 |
| 2006/0255324 | A1* | 11/2006 | Davenport | E04H 17/166 256/24 |
| 2007/0131920 | A1* | 6/2007 | Platt | E04F 11/181 256/65.02 |
| 2012/0080655 | A1* | 4/2012 | Coffin | E04G 21/3204 29/525.01 |
| 2018/0135330 | A1* | 5/2018 | Lee | E04H 17/18 |

FOREIGN PATENT DOCUMENTS

| | | | | |
|---|---|---|---|---|
| CA | 2651731 | A1 * | 7/2010 | E01F 13/028 |
| CA | 2704888 | A1 * | 11/2011 | E04G 21/3219 |
| GB | 2259923 | A * | 3/1993 | E04H 12/2269 |
| GB | 2487239 | A * | 7/2012 | E04H 17/1413 |

* cited by examiner

RAIL BRACKET

FIELD OF THE DISCLOSURE

This disclosure relates to construction safety assemblies, and particularly to temporary safety barriers.

BACKGROUND OF THE DISCLOSURE

Construction sites often present hazards to workers. One hazard is found in balconies or edges of a second or higher floor, in which temporary safety guardrails or barriers are used to prevent personnel and equipment from falling off the edge. Methods and equipment for improving safety guardrails are sought.

SUMMARY

Implementations of the present disclosure include a guardrail assembly that includes a first bracket coupled to a first vertical surface. The first bracket includes a first socket configured to support a first portion of a first horizontal rail. The first socket has a first support surface and two walls extending vertically away from the first support surface, the two walls defining a gap therebetween to receive the first portion of the first rail. The first socket defines an opening at an end of the two walls opposite the first support surface to allow the first horizontal rail to be removed from the first socket by lifting the rail. The first socket is disposed at a first vertical elevation along a length of the first bracket. The second socket resides at a second vertical elevation less than the first vertical elevation. The second socket supports a first portion of a second horizontal rail. The second socket has a second support surface and two walls extending vertically away from the second support surface. The two walls define a gap therebetween to receive the first portion of the second rail. The second socket defines an opening at an end of the two walls opposite the second support surface to allow the second horizontal rail to be removed from the second socket by lifting the rail. The guardrail assembly also includes a second bracket coupled to a second vertical surface spaced from the first vertical surface. The second bracket faces the first bracket. The second bracket includes a third socket that supports a second portion of the first rail. The third socket has a third support surface and two walls extending vertically away from the third support surface. The two walls define a gap therebetween to receive the second portion of the first rail. The third socket defining an opening at an end of the two walls opposite the third support surface to allow the first rail to be removed from the third socket by lifting the rail. The third socket is disposed at a third vertical elevation along a length of the second bracket similar to the first vertical elevation. The second bracket also includes a fourth socket residing at a fourth vertical elevation less than the third vertical elevation and similar to the second vertical elevation. The fourth socket supports a second portion of the second rail. The fourth socket has a fourth support surface and two walls extending vertically away from the fourth support surface. The two walls define a gap therebetween to receive the second portion of the second rail. The fourth socket defines an opening at an end of the two walls opposite the fourth support surface to allow the second rail to be removed from the fourth socket by lifting the rail.

In some implementations, the first bracket has a longitudinal flange from which the first and second sockets extend.

The longitudinal flange defining a hole configured to receive a mechanical fastener configured to attach the first bracket to the first vertical surface.

In some implementations, a first wall of the two walls of the first socket defines a first hole and wherein a second wall of the two walls of the first socket defines a second hole generally concentric with the first hole. The first hole receives a mechanical fastener configured to attach the first bracket to a third vertical surface extending along a plane parallel to the two walls. The second hole receives a torque-imparting tool configured to impart torque to the mechanical fastener. In some implementations, the second wall defines a third hole and the first wall defines a fourth hole generally concentric with the third hole. The third hole receives a mechanical fastener configured to attach the first bracket to a fourth vertical surface extending along a plane parallel to the two walls. The fourth hole receives a torque-imparting tool configured to impart torque to the mechanical fastener.

In some implementations, the longitudinal flange comprises a flange portion extending vertically away from the support surface of the second socket to a base of the first bracket. The base supports the bracket on a horizontal surface.

In some implementations, the longitudinal flange extends from a top surface of the walls of the first socket to the support surface of the second socket. The longitudinal flange extends between two lateral surfaces coplanar with exterior surfaces of the walls of the first socket and the second socket.

In some implementations, each socket is a U-shaped socket, the U-shaped socket configured to prevent the respective portion of the respective horizontal rail from moving laterally away from the respective U-shaped socket.

In some implementations, each rail is a two-by-four lumber rail and the U-shaped socket receives and supports the two-by-four lumber rail. The support surface of the U-shaped socket supports a bottom surface of the two-by-four lumber rail and the gap between the two walls has a length of between 1.5 and 2.5 inches.

In some implementations, the first socket has a back wall extending between the two walls and away from the support surface. The back wall defines a hole configured to receive a mechanical fastener configured to attach the first bracket to the vertical surface.

In some implementations, the first support surface is separated from the second support surface a distance of between 19 and 22 inches.

In some implementations, the first bracket further includes a longitudinal flange coupled to the sockets. The slot is an open slot defining an opening at an end of the two walls to allow the respective rail to be removed from the socket by lifting the rail. The longitudinal flange of the bracket has a front surface coplanar with a front surface of the walls and the support surface of the sockets. In some implementations, the first bracket further includes an L-shaped extension bracket coupled to and extending from a back surface of the longitudinal flange. The L-shaped extension bracket can be attached to the first vertical surface with the longitudinal flange spaced from the vertical surface.

Implementations of the present disclosure also include a bracket that includes a flange, a first socket, and a second socket. The flange can be attached to a vertical surface. The first socket is coupled to the flange and includes a base configured to support a beam. The first socket has two walls extending vertically away from the base. The two walls define a gap therebetween to receive the beam. The first socket defines an open end opposite the base to allow the beam to be removed from the socket by lifting the beam from the base. The second socket is coupled to the flange and spaced from the first socket. The second socket has a second base configured to support a second beam spaced from the first beam, and two walls extending vertically away from the base. The two walls define a gap therebetween to receive the second beam. The second socket defines an open end opposite the second base to allow the second beam to be removed from the socket by lifting the second beam from the second base.

In some implementations, a first wall of the two walls of the first socket defines a first hole and a second wall of the two walls defines a second hole generally concentric with the first hole. The first hole receives a mechanical fastener configured to attach the first bracket to a second vertical surface extending parallel to a plane of the first wall and with the flange detached from the first vertical surface. The second hole receives a torque-imparting tool configured to impart torque to the mechanical fastener.

In some implementations, the first beam and the second beam have equivalent widths. The first socket is spaced from the second socket a distance such that, with the beams supported on their respective sockets, a top surface of the first beam is spaced from a top surface of the second beam a distance of about 21 inches.

In some implementations, the flange extends vertically away from the two walls away from the socket. The flange extends laterally between two side surfaces coplanar with exterior surfaces of the walls of the first socket and the second socket.

In some implementations, the bracket defines a uniform thickness such that a front surface of the flange is coplanar with a front surface of the two walls.

Implementations of the present disclosure include a method of assembling safety guardrails. The method includes placing a first rail on a first socket of a first bracket attached to a first vertical surface. The first socket has a base configured to support a first portion of the first rail and has two walls extending vertically away from the base. The two walls define a gap therebetween to receive the first portion of the first rail to retain the first rail on the base. The first socket allows the first rail to be removed from the first socket by lifting the first rail from the base. The method also includes placing a second portion of the first rail on a third socket of a second bracket attached to a second vertical surface spaced from the first vertical surface. The second bracket faces the first bracket. The third socket is similar to the first socket such that the third socket allows the first rail to be removed from the third socket by lifting the first rail from the third socket. The method also includes placing a first portion of a second rail on a second socket of the first bracket. The second socket resides at a vertical location along the first bracket away from the first socket. The second socket is similar to the first socket such that the second socket allows the second rail to be removed from the second socket by lifting the second rail from the second socket. The method also includes placing a second portion of the second rail on a fourth socket of the second bracket. The fourth socket residing at a vertical location along the second bracket away from the third socket. The fourth socket is similar to the first socket such that the fourth socket allows the second rail to be removed from the fourth socket by lifting the second rail from the fourth socket.

In some implementations, placing the respective portions of the first rail and second rail on the respective sockets includes placing a top surface of the first rail separated from a top surface of the second rail by a distance of 21 inches.

DETAILED DESCRIPTION

The present disclosure describes a temporary bracket for a temporary safety guardrail or handrail. Temporary safety guardrails are used to secure the edges of construction sites (e.g., balconies) to prevent personnel or equipment from falling. Such barriers are temporary because they may be removed during construction for various purposes and they are ultimately replaced by permanent guardrails. For example, safety guardrails can be temporarily removed to allow large equipment deliveries. Currently, most temporary safety guardrails are made of horizontal lumbers nailed to vertical lumbers attached to the wall. Such guardrails can present hazards and can be difficult to remove when needed. For example, when the horizontal lumber is not properly nailed to the vertical lumber, the horizontal lumber can come off under stress, causing serious injuries and/or death. Additionally, removing a nailed horizontal lumber often requires tools (e.g., a hammer). Removing the horizontal lumber without the proper tools can damage the wall and cause injuries. For example, during a delivery, delivery personnel without proper tools may improperly remove the nailed guardrail (e.g., by kicking the guardrail or otherwise braking the guardrail), causing damage to the wall supporting the guardrail. The delivery personnel can also increase the hazard of the site by leaving the guardrail completely off the wall or by improperly replacing it and leaving a guardrail that looks safe but is not, creating an even greater safety hazard for the construction personnel. The present disclosure describes a bracket that complies with safety requirements and, at the same time, allows quick removal of the horizontal lumber. The temporary bracket of the present disclosure has a U-shaped socket that receives an end of a horizontal rail (e.g., a top rail or mid rail) and allows the rail to be removed by lifting the rail. The temporary bracket could also be used to hold a beam, a pole, or a rod in other applications.

Particular implementations of the subject matter described in this specification can be implemented so as to realize one or more of the following advantages. For example, the bracket of the present disclosure may allow quick removal of the horizontal rails of a temporary guardrail without requiring any tools to do so. Because tools are not necessary for the removal or replacement of the temporary guardrails, it would increase the consistency of the guardrails being replaced after every removal, thus significantly increasing safety. Because the bracket itself remains secured and is not being moved, safety would be enhanced by the increased effectiveness of the bracket securely holding each horizontal rail under stress. The bracket can also allow multiple configurations by allowing the bracket to attach to surfaces that face each other or surfaces that do not face each other.

Figure 1:
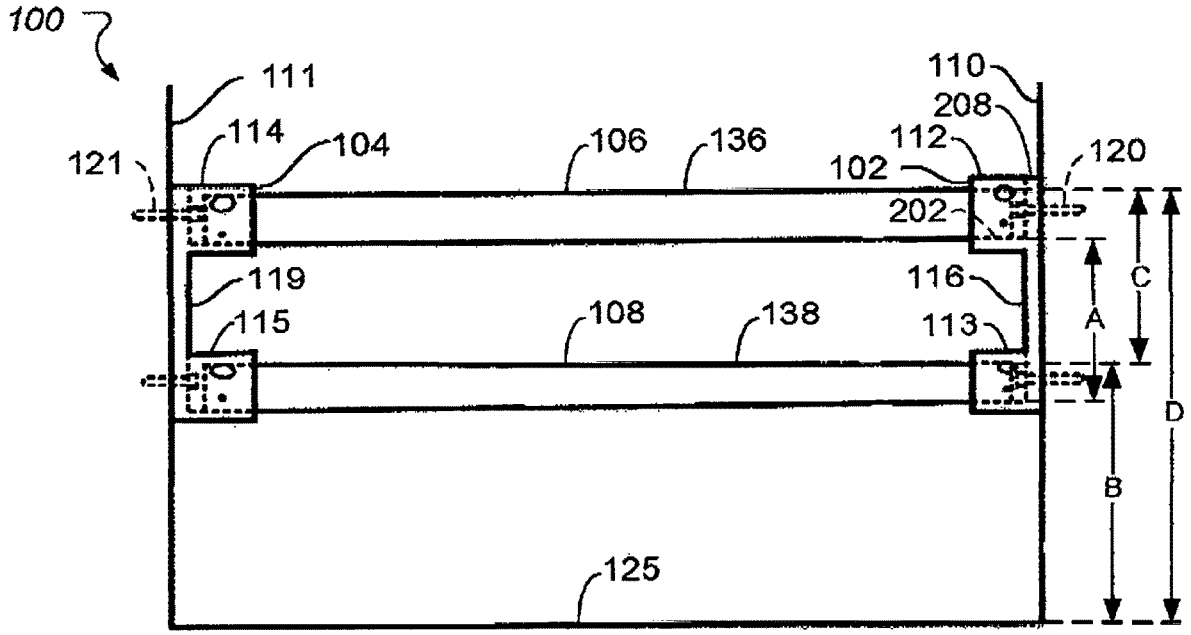
FIG. 1 is a front schematic view of a safety guardrail assembly according to a first implementation of the present disclosure.

FIG. 1 shows a front view of a safety guardrail assembly or system 100 that includes a first bracket 102 (e.g., a temporary guardrail bracket), a second bracket 104 similar to first bracket 102, a first horizontal rail 106 (e.g., a top rail) and a second horizontal rail 108 (e.g., a mid rail). First bracket 102 is secured, with one or more mechanical fasteners 120, to a first vertical surface 110 (e.g., a wall) that extends from a horizontal surface 125 (e.g., a floor). Second bracket 104 is secured, with one or more mechanical fasteners 121, to a second vertical surface 111 opposing first vertical surface 110. First bracket 102 and second bracket 104 face each other to support opposite ends of rails 106 and 108.

Figure 2:
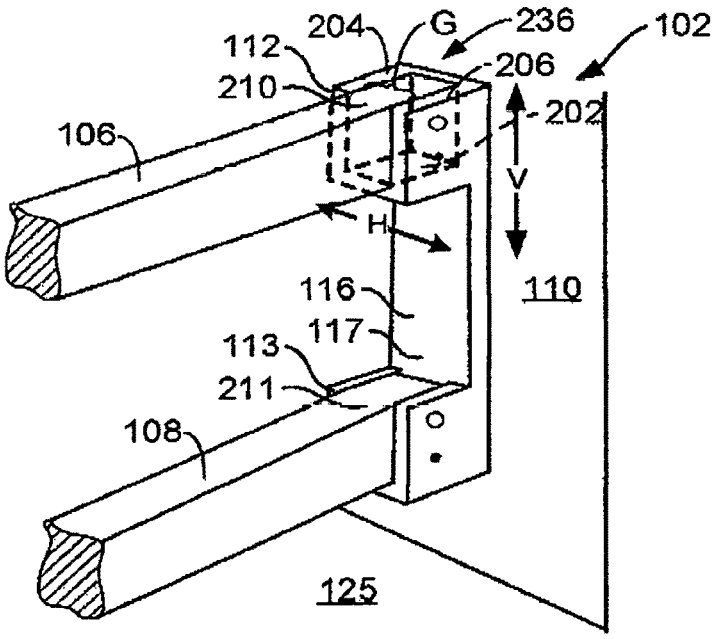
FIG. 2 is a perspective schematic view of a portion of the safety guardrail assembly of FIG. 1.

First bracket 102 includes a first socket 112 and a second socket 113 below first socket 112. First socket 112 and second socket 113 receive and support ends of respective rails 106 and 108. First socket 112 and second socket 113 extend from a common longitudinal flange 116. Similarly, second bracket 104 has a third socket 114 and a fourth socket 115 that extend from a common longitudinal flange 119. Referring also to FIG. 2, longitudinal flange 116 has a wide surface 117 that is on a vertical plane parallel to vertical surface 110. Mechanical fasteners 120 and 121 can extend through the middle of the flange (e.g., between the sockets) or, as shown in FIG. 1, through a back wall 208 of the flange at the sockets.

As shown in FIG. 1, with second bracket 104 coupled to second vertical surface 111 and first bracket 102 coupled to first vertical surface 110, second bracket 104 faces first bracket 102 to support opposite ends of rails 106 and 108 in a horizontal or generally horizontal position. First bracket 102 and second bracket 104 can be used in construction sites such as in balconies that do not have permanent guardrails. Guardrail assembly 100 can be designed to comply with the Occupational Safety and Health Administration (OSHA) standards for temporary safety guardrails. Specifically, guardrail assembly 100 can comply with parts 1926.502(b)(1) and 1926.502(b)(1) of the 29 CFR OSHA standard, which requires that "[t]op edge height of top rails, or equivalent guardrail system members, shall be 42 inches (1.1 m) plus or minus 3 inches (8 cm) above the walking/working level," and "[m]idrails, screens, mesh, intermediate vertical members, or equivalent intermediate structural members shall be installed between the top edge of the guardrail system and the walking/working surface when there is no wall or parapet wall at least 21 inches (53 cm) high."

For example, brackets 102 and 104 can be positioned at an elevation such that a top surface 138 of second rail 108 is separated from floor 125 a distance 'B' of 21 inches and a top surface 136 of first rail 106 is separated from floor 125 a distance 'D' of 42 inches. Additionally, top sockets 112 and 114 can be separated from bottom sockets 113 and 115 a distance so that, with the brackets 102 and 104 secured to their respective walls, top surface 138 of second rail 108 is separated from top surface 136 of first rail 106 a distance 'C' of 21 inches. For instance, a base of the first socket 112 can be spaced from a base of the second socket 113 a distance 'A' of 21 inches such that, if rails 106 and 108 have the same width, their top surfaces 136 and 138 are spaced 21 inches from each other.

As shown in FIG. 2 and as further described in detail below with respect to FIG. 5, first socket 112 (and each socket 113, 114, and 115) has a support surface or base 202 and two parallel walls 204 and 206 that extend vertically away (e.g., upwardly) from support surface 202. The two vertical walls 204 and 206 define a gap 'G' therebetween to receive first portion or end 210 of first rail 106. The two walls 204 and 206 prevent first portion 210 of first rail 106 from moving laterally away from first socket 112. Support surface 202 prevents first portion 210 of first rail 106 from moving vertically downward with respect to the base 202, away from first socket 112. In other words, walls 204 and 206 prevent end 210 of first rail 106 from moving in a horizontal or lateral direction 'H' (e.g., with respect to floor 125) and support surface 202 prevents first rail 106 from moving in a vertical downward direction 'V'. First socket 112 does not prevent a vertically upward movement of first rail 106, allowing first rail 106 to be removed from first socket 112 by lifting first rail 106 from support surface 202. For example, sockets 112, 113, 114, and 115 can be U-shaped sockets that define an opening 236 at a top end of the two walls 204 and 206 to allow the respective rail to be removed from the socket by lifting the rail.

Second socket 113 resides below first socket 112 to support second rail 108. Second socket 113 supports a first portion or end 211 of second rail 108. The first socket 112 is disposed at a first vertical elevation along flange 116 and second socket 113 is disposed at a second vertical elevation along flange 116 less than the first vertical elevation.

As shown in FIG. 1, second bracket 104 is similar to or the same as first bracket 102. For example, one could use two identical brackets 102 for assembly 100 by securing a first bracket to wall 110 and then flipping the other bracket to secure it to wall 111. Second bracket 104 receives and supports opposite ends of first rail 106 and second rail 108. First bracket 102 and second bracket 104 are secured to respective walls to removably retain or support safety rails 106 and 108 so that the rails can be quickly removed. Safety rails 106 and 108 can be quickly removed from brackets 102 and 104 by lifting the rails. By doing so, one can quickly unblock access to the area (e.g., a balcony) guarded by the assembly 100 without using tools to detach the rails from the brackets.

With the first bracket 102 and second bracket 104 attached to their respective walls, third socket 114 is disposed at a third vertical elevation along flange 117 that is similar to the first vertical elevation (the elevation of the first socket 112). Fourth socket 115 resides at a fourth vertical elevation less than the third vertical elevation and similar to the second vertical elevation (the elevation of the second socket 113).

Figure 3:
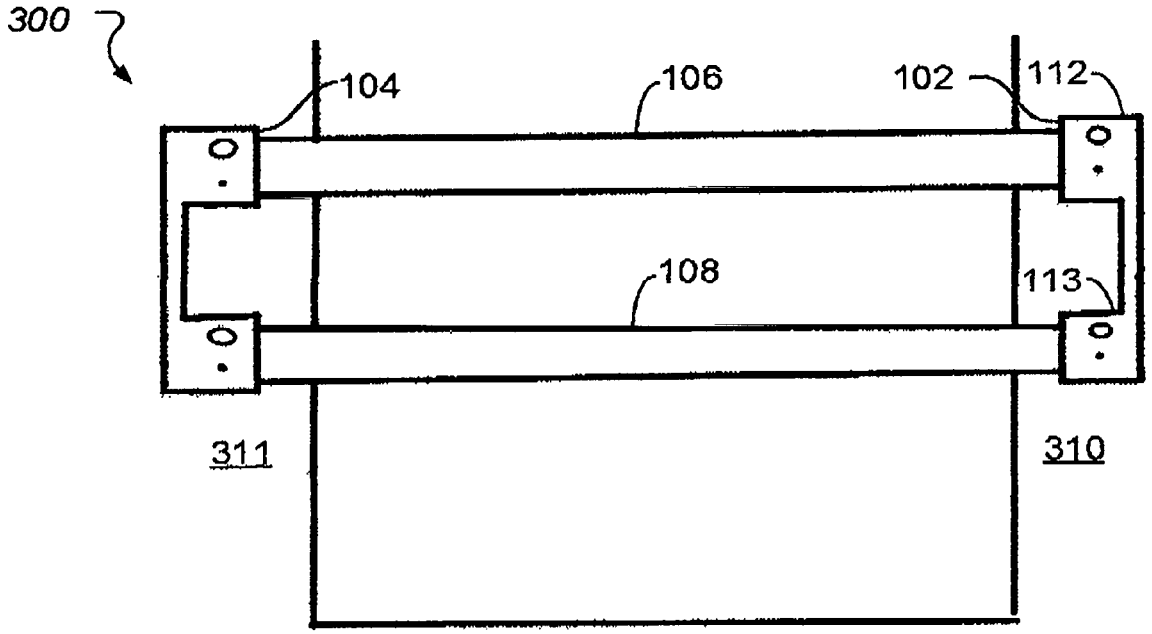
FIG. 3 is a front schematic view of a safety guardrail assembly according to a second implementation of the present disclosure.
Figure 4:
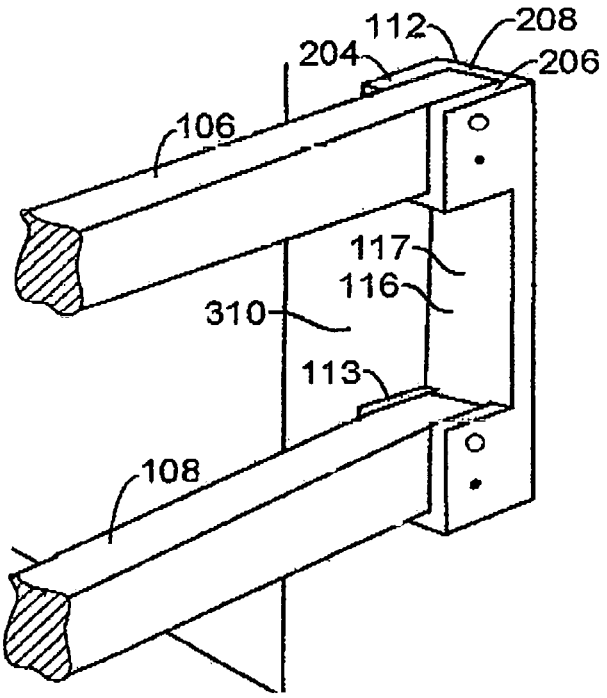
FIG. 4 is a perspective schematic view of a portion of the safety guardrail assembly of FIG. 3.

Referring to FIGS. 3 and 4, first bracket 102 can be attached to vertical surface 310 (e.g., an outwardly facing wall) and second bracket 104 can be attached to another vertical surface 311 (e.g., a different outwardly facing wall) to form a second safety guardrail assembly 300. Vertical surfaces 310 and 311 face in the same direction and extend along a common vertical plane. For example, as shown in FIG. 4, the walls 310 and 311 extend along a vertical plane parallel to walls 204 and 206. In such implementations, broad surface 117 of flange 116 is perpendicular to wall 310, with vertical wall 204 flat against wall 310. Thus, the brackets can be secured to a wall by placing the vertical walls of the sockets against the wall or placing the longitudinal flange against the wall.

Figure 5:
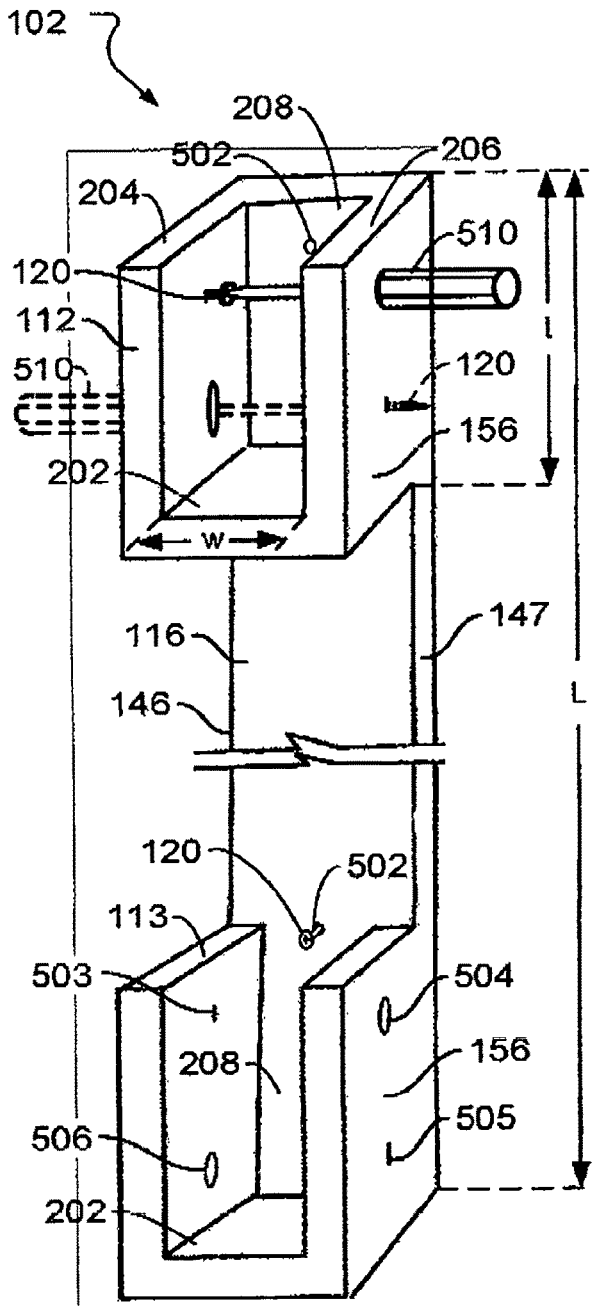
FIG. 5 is a perspective schematic view of a bracket according to a first implementation of the present disclosure.

Referring also to FIG. 5, bracket 102 has multiple holes to secure bracket 102 to different walls (see FIGS. 1 and 3), allowing bracket 102 to be arranged in different positions. Each vertical wall 204 and 206 of sockets 112 and 113 has apertures 503 and 504 of different sizes that accommodate a mechanical fastener or a torque-imparting tool 510 (e.g., a screwdriver, a drill, or a wrench) to attach bracket 102 to an outwardly facing wall 310 (see FIGS. 3 and 4). Flange 116 has one or more holes 502 to attach bracket 102 to a wall 110 that faces another wall (see FIGS. 1 and 2).

Specifically, flange 116 can define a hole 502 at the back wall 208 of each socket 112 and 113. Holes 502 receives a mechanical fastener 120 that attaches bracket 102 to the wall. The first vertical wall 204 of sockets 112 and 113 defines a first hole 503 and second vertical wall 206 (e.g., the opposite wall) defines a second hole 504 generally concentric with first hole 503. First hole 503 receives a mechanical fastener 120 that attaches bracket 102 to a different vertical surface 310 (see FIGS. 3 and 4). Second hole 504 is sized to receive torque-imparting tool 510 such as a handle of a screwdriver or the chuck of a drill. Torque-imparting tool 510 extends from second wall 206 toward first wall 204 to interface with mechanical fastener 120. In other words, first hole 503 can be smaller than second hole 504 to indicate a user which hole is configured to receive the mechanical fastener and which hole is configured to receive the tool. Similarly, to attach bracket 102 to a wall interfacing with second wall 206, second wall 206 defines a third hole 505 and first wall defines a fourth hole 506 generally concentric with third hole 505. Third hole 505 is sized to receive a mechanical fastener 120 and fourth hole 506 is sized to receive torque imparting tool 510. Third hole 505 can reside under second hole 504 and fourth hole 506 can reside under firsts hole 503. The holes 503, 504, 505, and 506 can be placed in different locations of the walls 204 and 206, such as along a common horizontal plane.

Bracket 102 can have a length 1' of about between 24 to 28 inches (e.g., 25.5 inches). For example, each socket 112 and 113 can have a length '1' of about between 3 to 5 inches (e.g., 4 inches) including the thickness of base 202 and the length of vertical walls 204 and 206. The length '1' of sockets 112 and 113 can be specific to the size of rails used in the guardrail assembly 100. For example, rails 106 and 108 (see FIG. 1) can be two-by-four lumber rails (with actual dimensions being 1.5 inches by 3.5 inches). Each socket 112 and 113 can be designed so that the lumbers fit snuggly on the sockets and the vertical walls 204 and 206 extend to about the top surface 136 and 138 of the rails 106 and 108. For example, the support surface 202 (and by extension, the gap G' between the two walls) can have a width 'w' of between 1.5 inches to 2.5 inches and the walls can have a length of about 3.5 inches or more.

As shown in FIG. 5, first socket 112 and second socket 113 reside at opposite ends of longitudinal flange 116. For example, first socket 112 resides at a first vertical elevation along length 'L' of bracket 102 and second socket 113 resides at a second vertical elevation along length 1' less than the first vertical elevation. Longitudinal flange 116 includes back wall 208, so flange 116 can extend from a top surface of the walls 204 and 206 of first socket 112 to support surface 202 of second socket 113. Longitudinal flange 116 extends between two lateral surfaces 146 and 147 that are coplanar with exterior surfaces 156 of the vertical walls 204 and 206.

Figure 6:
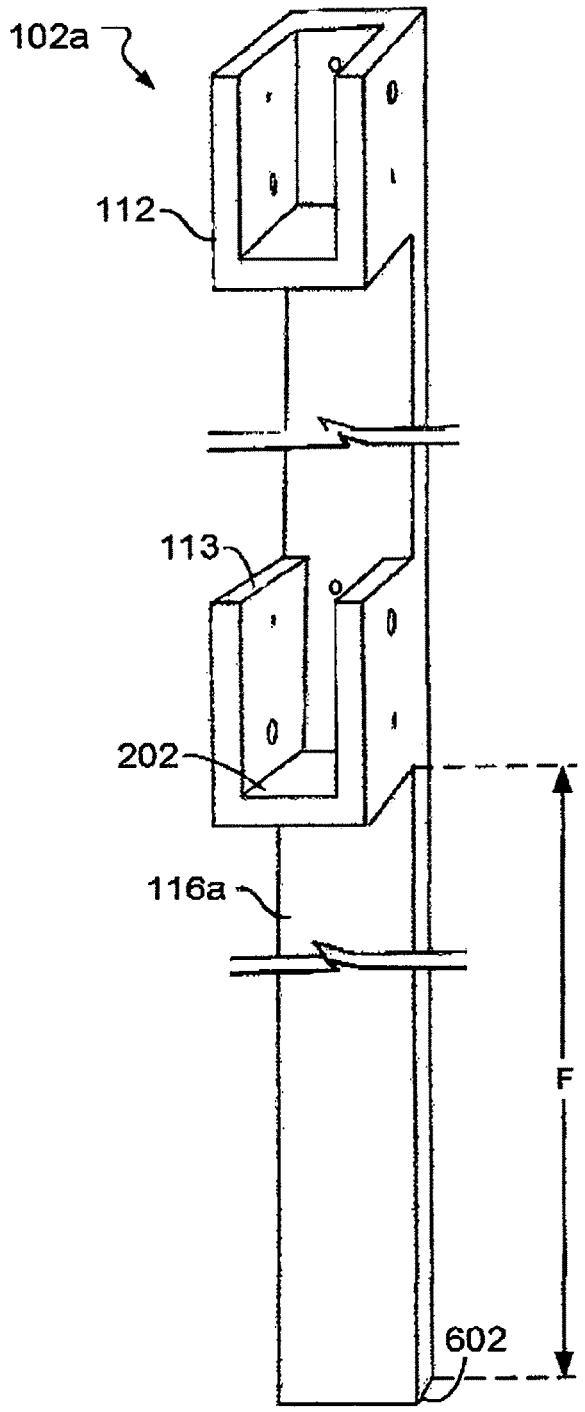
FIG. 6 is a perspective schematic view of a bracket according to a second implementation of the present disclosure.

FIG. 6 shows a bracket 102*a* according to a different configuration. Bracket 102*a* includes a bottom flange portion 116*a* that extends vertically away (e.g., downwardly) from base 202 of second socket 113 to a base 602 of bracket 102*a*. Base 602 supports bracket 102*a* on a horizontal surface (e.g., the floor 125 shown in FIG. 1). Bottom flange portion 116*a* can have a length 'F' of about 17 inches such that the top surface 138 of mid rail 108 is separated from the floor 125 by a distance of about 21 inches with base 602 supported on the floor.

Figure 7:
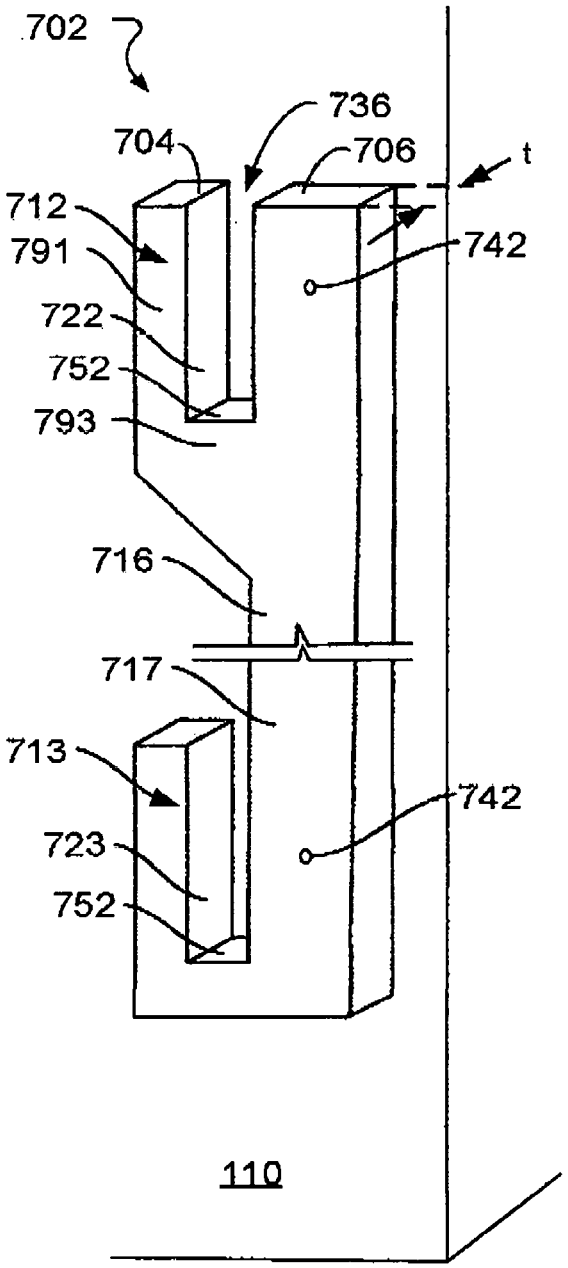
FIG. 7 is a perspective schematic view of a bracket according to a third implementation of the present disclosure.
Figure 8:
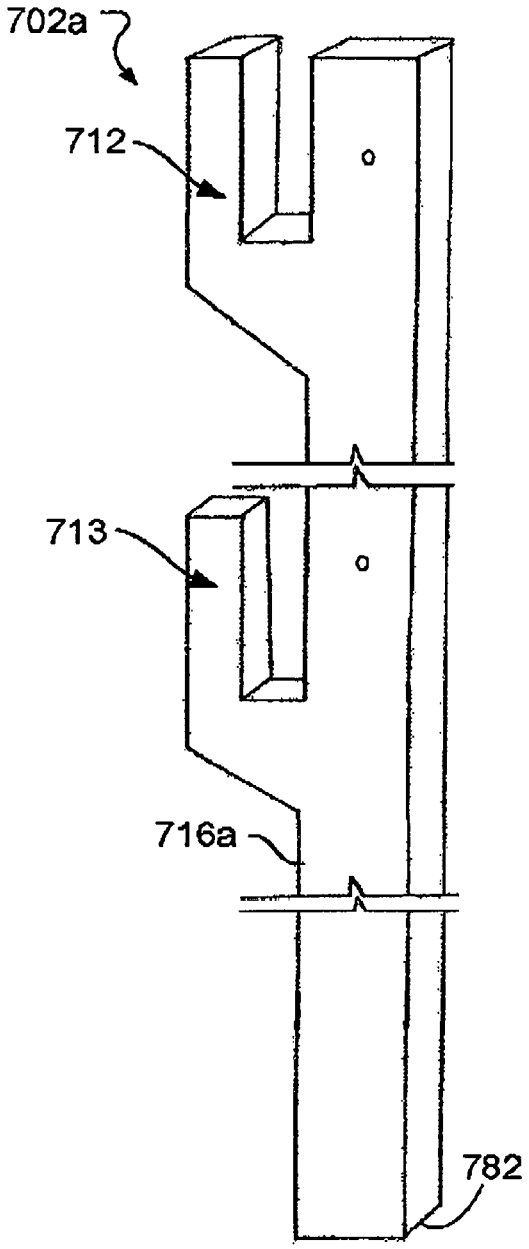
FIG. 8 is a perspective schematic view of a bracket according to a fourth implementation of the present disclosure.
Figure 9:
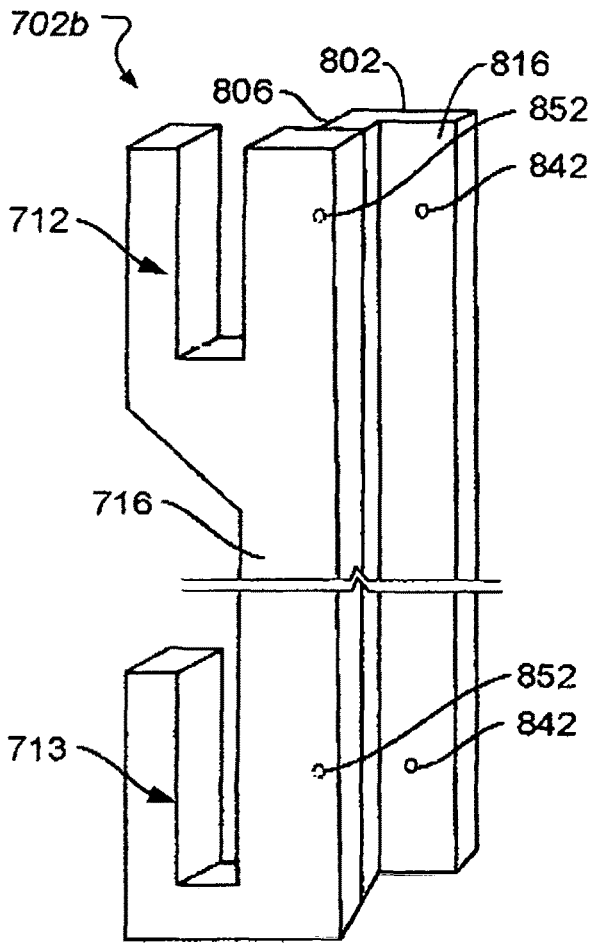
FIG. 9 is a perspective schematic view of a bracket according to a fifth implementation of the present disclosure.

FIGS. 7-9 show a bracket according to different implementations. FIG. 7 illustrates a bracket 702 of uniform thickness 't', in which sockets 712 and 713 include or are formed as longitudinal slots 722 and 723 respectively. Bracket 702 has a longitudinal flange 716 that connects the sockets 712 and 713, similar to bracket 102 of FIGS. 1-5. Longitudinal flange 716 has one or more holes 742 that receive a mechanical fastener that attaches bracket 702 to a vertical surface 110 (so that the two brackets holding the rails face each other, similar to the guardrail assembly 100 of FIG. 1). Each slot 722 and 723 is an open slot that defines a base 752, two vertical walls 704 and 706 extending from the base 752, and an opening 736 at an end of the two walls 704 and 706. Opening 736 allows the respective rail to be removed from the socket 712 and 713 by lifting the rail. Longitudinal flange 716 has a front surface 717 that is coplanar with a front surface 791 of the vertical walls 704 and 706 and a front surface 793 of the base 752.

FIG. 8 shows a bracket 702*a* according to a different implementation. Similar to the bracket 102*a* of FIG. 6, bracket 702*a* has a bottom flange portion 716*a* that extends vertically away from second socket 713 to a base 782 that supports bracket 702*a* on a horizontal surface (e.g., the floor 125 shown in FIG. 1). Bottom flange portion 716*a* can have a length similar to the bottom flange portion 116*a* of FIG. 6.

FIG. 9 shows a bracket 702*b* similar to the bracket 702 of FIG. 7, but with an additional L-shaped extension bracket 802 (e.g., having an L-shaped cross-section) configured to be attached to wall 110. Extension bracket 802 has a longitudinal flange 816 with holes 842 that receive mechanical fasteners to attach bracket 702*b* to wall 110. Extension bracket 802 has a vertical wall 806 that extends away from flange 816 to flange 716 of bracket 702*b* to position flange 716 away from wall 110. Flange 716 can be permanently or temporarily attached to extension bracket 802. For example, flange 716 can receive mechanical fasteners through holes 852 to secure flange 716 to extension bracket 802. Extension bracket 802 can be used to separate sockets 712 and 713 of bracket 702*b* from wall 110, such as in cases in which thickness 't' (see FIG. 7) of flange 716 and sockets 712 and 713 is too small to safely secure the guardrails in place.

Figure 10:
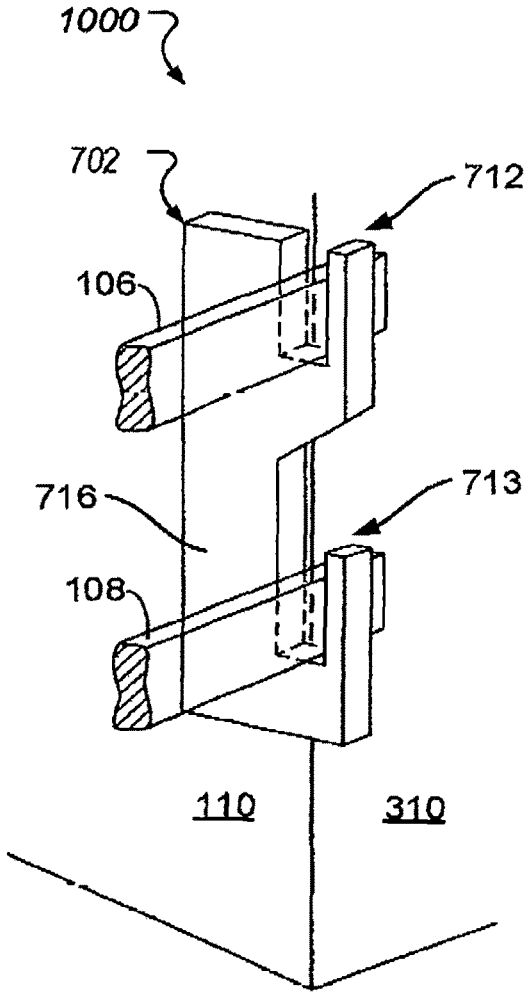
FIG. 10 is a perspective schematic view of a portion of a safety guardrail assembly according to a third implementation of the present disclosure.

FIG. 10 shows bracket 702 of FIG. 7 (or the brackets 702*a* or 702*b* of FIGS. 8 and 9) in a safety guardrail assembly 1000 according to a different implementation. Flange 716 of bracket 702 is attached to an edge of wall 110 with sockets 712 and 713 sticking out of wall 110 so that rails 106 and 108 can extend beyond wall 110 along external wall 310.

Figure 11:
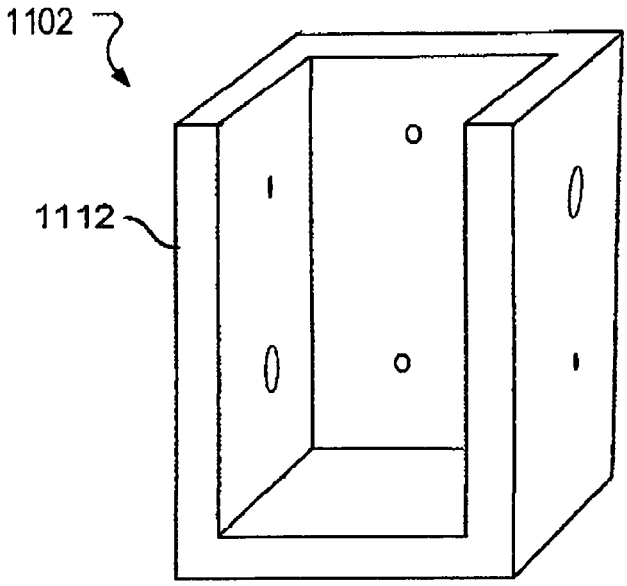
FIG. 11 is a perspective schematic view of a bracket according to a sixth implementation of the present disclosure.
Figure 12:
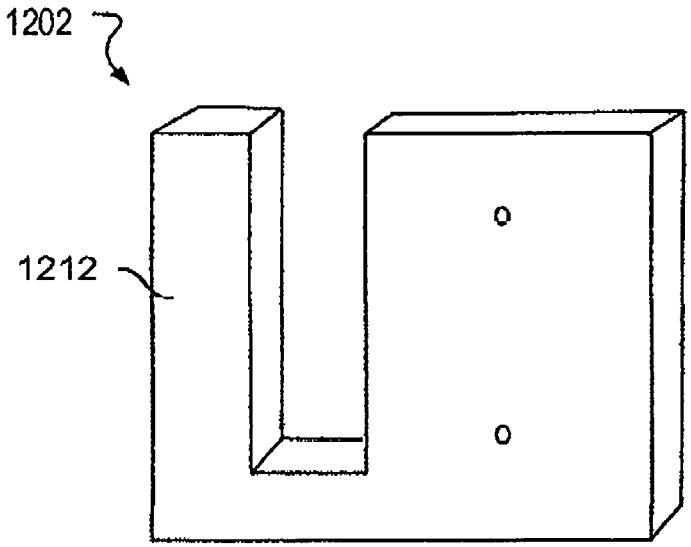
FIG. 12 is a perspective schematic view of a bracket according to a seventh implementation of the present disclosure.

FIGS. 11 and 12 show a different implementation of a rail bracket. FIG. 11 illustrates bracket 1102 with just one socket 1112. Two brackets 1102 can be used in place of the bracket 102 shown in FIG. 1. Thus, as shown in FIGS. 1-4, each bracket 1102 can be attached to walls 110 and 111 or walls 310 and 311 to support a respective end of a safety guardrail 106 and 108. FIG. 12 shows a bracket 1202 with a socket 1212 similar to the sockets 712 and 713 of bracket 702 in FIG. 7. Bracket 1202 is configured to work similarly to bracket 1102 of FIG. 11.

Figure 13:
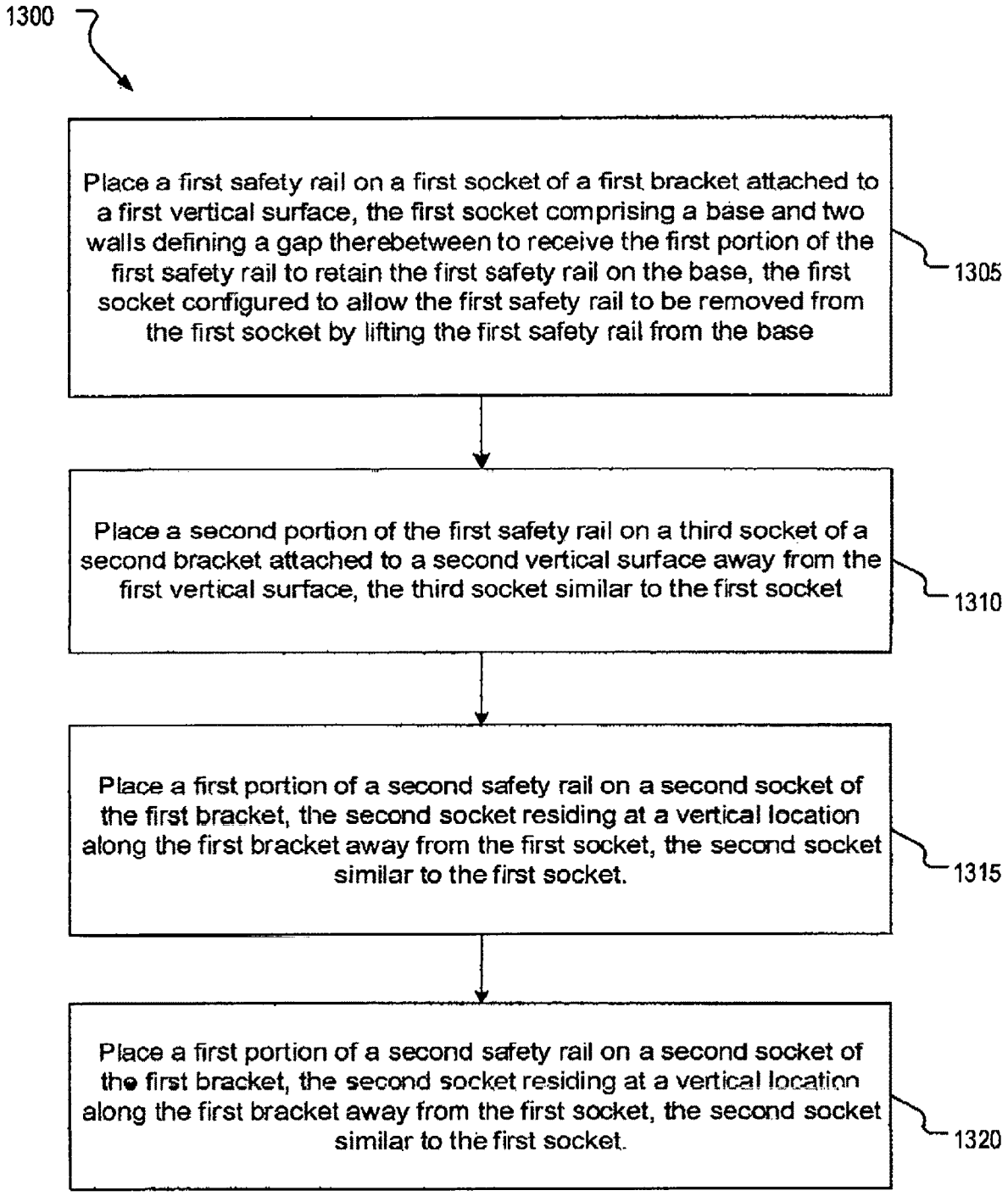
FIG. 13 is a flow chart of an example method of assembling safety guardrails.

FIG. 13 shows a flowchart of an example method (1300) of assembling a safety guardrail system (e.g., the system 100 shown in FIG. 1). The method includes placing a first safety rail on a first socket of a first bracket attached to a first vertical surface, the first socket comprising a base configured to support a first portion of the first safety rail and comprising two walls extending vertically away from the base, the two walls defining a gap therebetween to receive the first portion of the first safety rail to retain the first safety rail on the base. The first socket allows the first safety rail to be removed from the first socket by lifting the first safety rail from the base (1305). The method also includes placing a second portion of the first safety rail on a third socket of a second bracket attached to a second vertical surface spaced from the first vertical surface. The second bracket facing the first bracket. The third socket is similar to the first socket such that the third socket allows the first safety rail to be removed from the third socket by lifting the first safety rail from the third socket (1310). The method also includes placing a first portion of a second safety rail on a second socket of the first bracket, the second socket residing at a vertical location along the first bracket away from the first socket. The second socket is similar to the first socket such that the second socket allows the second safety rail to be removed from the second socket by lifting the second safety rail from the second socket (1315). The method also includes placing a second portion of the second safety rail on a fourth socket of the second bracket, the fourth socket residing at a vertical location along the second bracket away from the third socket. The fourth socket is similar to the first socket such that the fourth socket allows the second safety rail to be removed from the fourth socket by lifting the second safety rail from the fourth socket (1320).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A guardrail assembly comprising:

a first bracket coupled to a first vertical surface, the first bracket comprising:

a first socket configured to support a first portion of a first horizontal rail, the first socket comprising a first support surface and two walls extending vertically away from the first support surface, the two walls defining a gap therebetween to receive the first portion of the first rail, the first socket defining an opening at an end of the two walls opposite the first support surface to allow the first horizontal rail to be removed from the first socket by lifting the rail, the first socket disposed at a first vertical elevation along a length of the first bracket, and a second socket residing at a second vertical elevation less than the first vertical elevation, the second socket configured to support a first portion of a second horizontal rail, the second socket comprising a second support surface and two walls extending vertically away from the second support surface, the two walls defining a gap therebetween to receive the first portion of the second rail, the second socket defining an opening at an end of the two walls opposite the second support surface to allow the second horizontal rail to be removed from the second socket by lifting the rail; and a second bracket coupled to a second vertical surface spaced from the first vertical surface, the second bracket facing the first bracket and comprising:

a third socket configured to support a second portion of the first rail, the third socket comprising a third support surface and two walls extending vertically away from the third support surface, the two walls defining a gap therebetween to receive the second portion of the first rail, the third socket defining an opening at an end of the two walls opposite the third support surface to allow the first rail to be removed from the third socket by lifting the rail, the third socket disposed at a third vertical elevation along a length of the second bracket similar to the first vertical elevation, and a fourth socket residing at a fourth vertical elevation less than the third vertical elevation and similar to the second vertical elevation, the fourth socket configured to support a second portion of the second rail, the fourth socket comprising a fourth support surface and two walls extending vertically away from the fourth support surface, the two walls defining a gap therebetween to receive the second portion of the second rail, the fourth socket defining an opening at an end of the two walls opposite the fourth support surface to allow the second rail to be removed from the fourth socket by lifting the rail;

wherein the first bracket comprises a longitudinal flange from which the first and second sockets extend, the longitudinal flange defining an aperture configured to receive a mechanical fastener configured to attach the first bracket to the first vertical surface; and wherein a first wall of the two walls of the first socket defines a first aperture and wherein a second wall of the two walls of the first socket defines a second aperture generally aligned with the first aperture, the first aperture configured to receive a mechanical fastener configured to attach the first bracket to a third vertical surface extending along a plane parallel to the two walls, the second aperture configured to receive a torque-imparting tool configured to impart torque to the mechanical fastener.

2. The guardrail assembly of claim 1, wherein the second wall defines a third aperture and wherein the first wall defines a fourth aperture generally aligned with the third aperture, the third aperture configured to receive a mechanical fastener configured to attach the first bracket to a fourth vertical surface extending along a plane parallel to the two walls, the fourth aperture configured to receive a torque-imparting tool configured to impart torque to the mechanical fastener.

3. The guardrail assembly of claim 1, wherein the longitudinal flange comprises a flange portion extending vertically away from the support surface of the second socket to a base of the first bracket, the base configured to support the bracket on a horizontal surface.

4. The guardrail assembly of claim 1, wherein each socket comprises a U-shaped socket, the U-shaped socket configured to prevent the respective portion of the respective horizontal rail from moving laterally away from the respective U-shaped socket.

5. The guardrail assembly of claim 4, wherein each rail is a two-by-four lumber rail and the U-shaped socket is configured to receive and support the two-by-four lumber rail, the support surface of the U-shaped socket configured to support a bottom surface of the two-by-four lumber rail and the gap between the two walls comprising a length of between 1.5 and 2.5 inches.

6. The guardrail assembly of claim 1, wherein the first support surface is separated from the second support surface a distance of between 19 and 22 inches.

7. The guardrail assembly of claim 1, wherein the first bracket defines a uniform thickness and wherein at least one of the first and second sockets comprises a slot configured to receive and support the respective rail.

8. The guardrail assembly of claim 7, wherein the first bracket further comprises a longitudinal flange coupled to the sockets, the slot comprising an open slot defining an opening at an end of the two walls to allow the respective rail to be removed from the socket by lifting the rail, the longitudinal flange of the bracket comprising a front surface coplanar with a front surface of the walls and the support surface of the sockets.

9. The guardrail assembly of claim 8, wherein the first bracket further comprises an L-shaped extension bracket coupled to and extending from a back surface of the longitudinal flange, the L-shaped extension bracket configured to be attached to the first vertical surface with the longitudinal flange spaced from the vertical surface.

10. A bracket comprising:

a flange configured to be attached to a vertical surface;

a first socket coupled to the flange, the first socket comprising:

a base configured to support a first beam, and two walls extending vertically away from the base, the two walls defining a gap therebetween to receive the beam, wherein the first socket defines an open end opposite the base to allow the beam to be removed from the socket by lifting the beam from the base; and a second socket coupled to the flange and spaced from the first socket, the second socket comprising:

a second base configured to support a second beam spaced from the first beam, and two walls extending vertically away from the base, the two walls defining a gap therebetween to receive the second beam, wherein the second socket defines an open end opposite the second base to allow the second beam to be removed from the socket by lifting the second beam from the second base;

wherein a first wall of the two walls of the first socket defines a first aperture and wherein a second wall of the two walls defines a second aperture generally aligned with the first aperture, the first aperture configured to receive a mechanical fastener configured to attach the bracket to the vertical surface or a second vertical surface extending parallel to a plane of the first wall, the second aperture configured to receive a torque-imparting tool configured to impart torque to the mechanical fastener.

11. The bracket of claim 10, wherein the first beam and the second beam comprise equivalent widths, the first socket spaced from the second socket a distance such that, with the beams supported on their respective sockets, a top surface of the first beam is spaced from a top surface of the second beam a distance of about 21 inches.

12. The bracket of claim 10, wherein the bracket defines a uniform thickness such that a front surface of the flange is coplanar with a front surface of the two walls.

13. A method of assembling safety guardrails, the method comprising:

placing a first rail on a first socket of a first bracket attached to a first vertical surface, the first socket comprising a base configured to support a first portion of the first rail and comprising two walls extending vertically away from the base, the two walls defining a gap therebetween to receive the first portion of the first rail to retain the first rail on the base, the first socket configured to allow the first rail to be removed from the first socket by lifting the first rail from the base, a first wall of the two walls of the first socket defining a first aperture and a second wall of the two walls defining a second aperture generally aligned with the first aperture, the first aperture configured to receive a mechanical fastener configured to attach the bracket to the first vertical surface extending parallel to a plane of the first wall, the second aperture configured to receive a torque-imparting tool configured to impart torque to the mechanical fastener;

placing a second portion of the first rail on a third socket of a second bracket attached to a second vertical surface away from the first vertical surface, the second bracket facing the first bracket, the third socket similar to the first socket such that the third socket allows the first rail to be removed from the third socket by lifting the first rail from the third socket;

placing a first portion of a second rail on a second socket of the first bracket, the second socket residing at a vertical location along a length of the first bracket away from the first socket, the second socket similar to the first socket such that the second socket allows the second rail to be removed from the second socket by lifting the second rail from the second socket; and placing a second portion of the second rail on a fourth socket of the second bracket, the fourth socket residing at a vertical location along a length of the second bracket away from the third socket, the fourth socket similar to the first socket such that the fourth socket allows the second rail to be removed from the fourth socket by lifting the second rail from the fourth socket.

14. The method of claim 13, wherein placing the respective portions of the first rail and second rail on the respective sockets comprises placing a top surface of the first rail separated from a top surface of the second rail by a distance of 21 inches.

15. A guardrail assembly comprising:

a first bracket coupled to a first vertical surface, the first bracket comprising:

a first socket configured to support a first portion of a first horizontal rail, the first socket comprising a first support surface and two walls extending vertically away from the first support surface, the two walls defining a gap therebetween to receive the first portion of the first rail, the first socket defining an opening at an end of the two walls opposite the first support surface to allow the first horizontal rail to be removed from the first socket by lifting the rail, the first socket disposed at a first vertical elevation along a length of the first bracket, and a second socket residing at a second vertical elevation less than the first vertical elevation, the second socket configured to support a first portion of a second horizontal rail, the second socket comprising a second support surface and two walls extending vertically away from the second support surface, the two walls defining a gap therebetween to receive the first portion of the second rail, the second socket defining an opening at an end of the two walls opposite the second support surface to allow the second horizontal rail to be removed from the second socket by lifting the rail; and a second bracket coupled to a second vertical surface spaced from the first vertical surface, the second bracket facing the first bracket and comprising:

a third socket configured to support a second portion of the first rail, the third socket comprising a third support surface and two walls extending vertically away from the third support surface, the two walls defining a gap therebetween to receive the second portion of the first rail, the third socket defining an opening at an end of the two walls opposite the third support surface to allow the first rail to be removed from the third socket by lifting the rail, the third socket disposed at a third vertical elevation along a length of the second bracket similar to the first vertical elevation, and a fourth socket residing at a fourth vertical elevation less than the third vertical elevation and similar to the second vertical elevation, the fourth socket configured to support a second portion of the second rail, the fourth socket comprising a fourth support surface and two walls extending vertically away from the fourth support surface, the two walls defining a gap therebetween to receive the second portion of the second rail, the fourth socket defining an opening at an end of the two walls opposite the fourth support surface to allow the second rail to be removed from the fourth socket by lifting the rail;

wherein the first bracket comprises a longitudinal flange from which the first and second sockets extend, the longitudinal flange defining an aperture configured to receive a mechanical fastener configured to attach the first bracket to the first vertical surface; and wherein the longitudinal flange extends from a top surface of the walls of the first socket to the support surface of the second socket, the longitudinal flange extending between two lateral surfaces coplanar with exterior surfaces of the walls of the first socket and the second socket.

16. A guardrail assembly comprising:

a first bracket coupled to a first vertical surface, the first bracket comprising:

a first socket configured to support a first portion of a first horizontal rail, the first socket comprising a first support surface and two walls extending vertically away from the first support surface, the two walls defining a gap therebetween to receive the first portion of the first rail, the first socket defining an opening at an end of the two walls opposite the first support surface to allow the first horizontal rail to be removed from the first socket by lifting the rail, the first socket disposed at a first vertical elevation along a length of the first bracket, and a second socket residing at a second vertical elevation less than the first vertical elevation, the second socket configured to support a first portion of a second horizontal rail, the second socket comprising a second support surface and two walls extending vertically away from the second support surface, the two walls defining a gap therebetween to receive the first portion of the second rail, the second socket defining an opening at an end of the two walls opposite the second support surface to allow the second horizontal rail to be removed from the second socket by lifting the rail; and a second bracket coupled to a second vertical surface spaced from the first vertical surface, the second bracket facing the first bracket and comprising:

a third socket configured to support a second portion of the first rail, the third socket comprising a third support surface and two walls extending vertically away from the third support surface, the two walls defining a gap therebetween to receive the second portion of the first rail, the third socket defining an opening at an end of the two walls opposite the third support surface to allow the first rail to be removed from the third socket by lifting the rail, the third socket disposed at a third vertical elevation along a length of the second bracket similar to the first vertical elevation, and a fourth socket residing at a fourth vertical elevation less than the third vertical elevation and similar to the second vertical elevation, the fourth socket configured to support a second portion of the second rail, the fourth socket comprising a fourth support surface and two walls extending vertically away from the fourth support surface, the two walls defining a gap therebetween to receive the second portion of the second rail, the fourth socket defining an opening at an end of the two walls opposite the fourth support surface to allow the second rail to be removed from the fourth socket by lifting the rail;

wherein the first socket comprises a back wall extending between the two walls and away from the support surface, the back wall defining an eperture configured to receive a mechanical fastener configured to attach the first bracket to the vertical surface.

17. A bracket comprising:

a flange configured to be attached to a vertical surface;

a first socket coupled to the flange, the first socket comprising:

a base configured to support a first beam, and two walls extending vertically away from the base, the two walls defining a gap therebetween to receive the beam, wherein the first socket defines an open end opposite the base to allow the beam to be removed from the socket by lifting the beam from the base; and a second socket coupled to the flange and spaced from the first socket, the second socket comprising:

a second base configured to support a second beam spaced from the first beam, and two walls extending vertically away from the base, the two walls defining a gap therebetween to receive the second beam, wherein the second socket defines an open end opposite the second base to allow the second beam to be removed from the socket by lifting the second beam from the second base;

wherein the flange extends vertically away from the two walls away from the socket, the flange extending laterally between two side surfaces coplanar with exterior surfaces of the walls of the first socket and the second socket.

* * * * *